United States Patent [19]

Bertini

[11] Patent Number: 4,508,093

[45] Date of Patent: Apr. 2, 1985

[54] TARGET-PIGEON LAUNCHER

[76] Inventor: Millo Bertini, 679 Garden St., Trumbull, Conn. 06611

[21] Appl. No.: 239,972

[22] Filed: Mar. 3, 1981

Related U.S. Application Data

[63] Continuation-in-part of Ser. No. 129,259, Mar. 11, 1980, abandoned.

[51] Int. Cl.[3] ..... F41B 15/00

[52] U.S. Cl. ..... 124/1; 124/41 R; 124/32; 124/34; 124/81

[58] Field of Search ..... 124/1, 34, 41 R, 32, 124/8, 40; 273/363, 364

[56] References Cited

U.S. PATENT DOCUMENTS

| | | | |
|---|---|---|---|
| 542,377 | 7/1895 | Shattuck | 273/363 X |
| 3,130,717 | 4/1964 | De Lossy et al. | 124/1 |
| 3,568,199 | 3/1971 | Hartness | 124/34 X |
| 3,570,467 | 3/1971 | Belokin | 124/41 X |
| 3,999,754 | 12/1976 | Krzysztofiak et al. | 124/34 X |
| 4,077,384 | 3/1978 | Montefeltro | 124/1 |
| 4,181,911 | 1/1980 | Black | 124/34 X |
| 4,205,651 | 6/1980 | Rovere | 124/1 |
| 4,206,919 | 6/1980 | Rovere | 273/364 |

*Primary Examiner*—Richard J. Apley
*Assistant Examiner*—William R. Browne
*Attorney, Agent, or Firm*—Arthur T. Fattibene

[57] ABSTRACT

A launcher for target pigeons of the kind having propellor type wings and which includes a drive unit having a rotating shaft to which a target pigeon is releasably connected. The target pigeon is releasably secured by a retainer head mounted on the rotating shaft and which is actuated by a control rod that is remotely actuated. The drive unit is mounted on a pivot to swivel during a launching operation. In one form, the drive unit is operatively associated with a vane which allows the launcher to oscillate when in operation to launch a target. In another embodiment, the oscillation of the launcher is effected by an eccentric mechanical drive which is connected to the drive unit.

23 Claims, 7 Drawing Figures

TARGET-PIGEON LAUNCHER

RELATED APPLICATION

This is a continuation in part application of a co-pending application Ser. No. 129,259 filed Mar. 11, 1980, entitled Improved Target-Pigeon Launcher, now abandoned.

FIELD OF THE INVENTION

The present invention relates to a target-pigeon launcher. More particularly this invention concerns a launching apparatus for target pigeons of the type having a central hub and a pair of oppositely extending propeller type wings.

BACKGROUND OF THE INVENTION

In earlier U.S. patent application No. 065,467, now U.S. Pat. No. 4,206,914, filed by another Aug. 10, 1979 as a continuation-in part of patent application No. 921,006 itself filed June 30, 1978, now U.S. Pat. No. 4,206,919, as a continuation in part of patent application Ser. Nos. 672,019, now U.S. Pat. No. 4,016,719, 882,907, now U.S. Pat. No. 4,274,636, and 892,921, now U.S. Pat. No.4,218,061, respectively filed Jan. 24, Mar. 1 and Apr. 3, 1978, there is disclosed a target pigeon having a generally flat web formed entirely of sheet metal with a central throughgoing hole at a web axis. This target pigeon has diametrically opposite web ends from each of which extends a sheet-metal wing which is tipped propeller-fashion relative to the other wing. In addition each of the web ends has a respective substantially straight, axially projecting, and outwardly tipped metal tab of V-section. A cup-shaped witness cap entirely of sheet metal is fittable to this web and has a circular rim centered on a cap axis and having a pair of diametrically opposite and radially outwardly extending lips each of which is formed with a respective throughgoing aperture through which the tabs project to hold the cap releasably in place on the web. Such a target pigeon is used for shooting practice, when launched by a machine such as described in earlier U.S. patent application Ser. No. 892,922 filed Apr. 3, 1978. This launcher rotates the target pigeon about an axis perpendicular to its wings and extending through the center of the pigeon, so that the wings tipped propeller-fashion relative to each other generate a backwardly moving air stream. Once released by the launcher such a target pigeon will fly axially forwardly off the launch head on which it is held. This launcher in turn is normally provided with a laterally projecting beak that turns with the head and that deflects the pigeon laterally so that as it flies off the launching machine it will follow an erratic trajectory closely resembling that of a flushed bird.

Shooting at such a target pigeon launched in such a manner has proven to be a relatively popular sport, as it closely reproduces the conditions of wing-shooting, while being substantially cheaper and ethically less objectionable. The unpredictability of the exact course which the target pigeon will follow offers excellent practice for hunting or wing-shooting.

The considerable disadvantage of this system is, however, that it is considerably more expensive than skeet shooting. Not only are the target somewhat more expensive, whether made of a synthetic resin or a sheet metal, but the launching equipment itself is relatively complex and regrettably also quite expensive.

OBJECTS OF THE INVENTION

It is therefore an object of the present invention to provide an improved launcher usable with the target pigeons described in the above cited patents and patent applications.

Another object is to provide such a launcher which is so simple that it will inherently have a long service life and will be relatively maintenance free.

Another object is to provide a launcher which is rendered self occilating about a vertical axis during a launching operation.

Another object is to provide a launcher having a launch head arranged to facilitate the loading and releasable locking of a target pigeon thereon.

SUMMARY OF THE INVENTION

These objects are attained according to the instant invention in a launcher having a drive unit including a motor and having an output shaft rotatable about a shaft axis above a base that is provided with mounting means for securing this unit to the base for swiveling of the unit on the base about an upright swivel axis with the shaft axis transverse to the swivel axis. A head fixed on this shaft and fittable with the target-pigeon hub is provided with retaining means for releasably securing the hub of the target pigeon to the head with the target wings extending radially from the shaft axis. Control means connected to the unit and to the retaining means energizes this unit with the target pigeon retained on the head to spin the target pigeon and thereby generate an axially backwardly flowing air stream. This control means can be effective through the retaining means to release the target pigeon which, when released, will fly axially forwardly off the launch head. According to this invention a vane or rudder is provided on the unit axially behind the launcher head in the air stream and pivotal about an upright vane axis between one end position inclined in one direction across the air stream and deflecting same to one side and another end position inclined oppositely across the air stream and deflecting same to the opposite side so that when the vane is inclined in the one direction to the air stream the drive unit is urged rotationally about the swivel axis on the base in one rotational sense and when the vane is oppositely inclined the unit is urged in the opposite rotational sense. A means is provided on the motor and on the base for reversing the inclination of the vane or rudder relative to the stream when the unit swivels on the base into either of two angularly offset reversing positions. Thus, the unit will oscillate between these reversing positions, as when urged by the deflected air stream into one of the reversing positions the inclination of the vane will be reversed to urge it back in the other direction.

The launcher according to the instant invention therefore operates in the same manner as the much more complicated launcher described in U.S. Pat. No. 4,077,384. Nonetheless the launcher according to the instant invention can be produced at a fraction of the cost of this more complex launcher. The reduction in moving parts and overall simplification of the mechanism not only reduces costs, but also reduces the possibility of parts failure and the launcher according to the instant invention can be expected to have an extremely long service life.

According to another feature of this invention the shaft axis is generally horizontal and the motor has a motor shaft on which the head is fixedly mounted and the motor shaft constitutes the output shaft. Thus it is possible to make the motor unit an extremely neat assembly, in fact having a cross section equal to that of the motor and a length only slightly greater than that of the motor. The retaining means can include a ball element radially displaceable in the head and axially engageable forwardly of the hub of the target pigeon, as well as a control rod extending co-axially through the motor shaft, and a solenoid in the motor unit axially behind the motor connected via the controll rod with the ball element. A spring normally urges the control rod backwardly and the ball radially outwardly so that energization of the solenoid pushes the control rod forwardly against the spring to allow the ball to move radially inwardly, thereby releasing the target pigeon. This is the basic system described in the above cited U.S. Pat. No. 4,007,384, except that the pushing fork is eliminated, and the control rod is pushed axially forwardly to allow the ball to retract rather than pulled axially backwardly. It is also, of course, possible when a sheet-steel target pigeon is being used to constitute the retaining means as an electromagnet in the head.

According to further features of this invention the vane axis is horizontally laterally offset from the motor axis and can indeed be tangent to a cylindrical housing of the drive unit in which the motor and solenoid are mounted. The vane is C-shaped, having an upper leg extending axially forwardly from the vane axis above the drive unit, a lower leg extending axially forwardly from the vane axis beneath the drive unit, and a bight extending vertically between the legs axially behind the motor unit and the vane axis. The upper leg is longer than the lower leg, and the two legs are coplanar. The bight is planar and bent at an angle of between 10° and 20° to the plane of the leg, being bent away from the plane of the legs relative to the shaft axis.

In accordance with another feature of this invention the means for reversing includes a tether connected between the base and a location of the vane offset from the vane axis. This tether is flexible and extensible and is taut in each of the reversing positions of the vane. It is also possible to provide a stop engageable with the vane at the location offset from the axis, these stops being fixed on the base.

According to this invention the motor unit is tiltable on the base unit about a horizontal tilt axis underneath the motor unit and perpendicular to the swivel axis. Thus the shaft and the vane axes can be jointly set at any of a plurality of angularly offset positions relative to the swivel axis. The motor axis is normally tipped forwardly upwardly to ensure upward launching of the target pigeon.

Stops are normally provided at the base of the motor unit for limiting angular displacement of the motor unit about the swivel axis on the base unit to a predetermined angle, normally the 135° through which a standard target-pigeon launcher must oscillate. Similarly, stops are provided on the vane limiting angular displacement of this vane relative to the motor unit about the vane axis.

These last mentioned stops limit angular displacement of the vane to 90° with the vane extending at an angle of 30° to an uprights plane including motor axis in one end position and at an angle of 60° to this plane in the opposite end position. The greater angle in the other end position is in the position with the vane largely swung away from the motor where it must scoop up more air to rotationally urge the motor unit on the base.

The entire unit is normally operated by remote control, and the motor unit is provided with a lamp that lights up an instant before the solenoid allows release of the target pigeon, so as to provide some warning for the shooter. According to this invention the control unit is wireless, either working with radio waves or infrared light.

In another form of the invention, oscillation of the launcher in asmuth is effected by a motor drive operatively connected to a eccentric which in turn is connected by a link to a second eccentric connected to the swivel shaft of the launcher motor. The arrangement is such that the actuation of the motor drive and its driven eccentric will result in transmitting an oscillating movement to the swivel shaft of the launcher.

BRIEF DESCRIPTION OF THE DRAWING

FIG. 4 is a vertical axial section through the launcher according to the instant invention.

SPECIFIC DESCRIPTION

Figure 1:
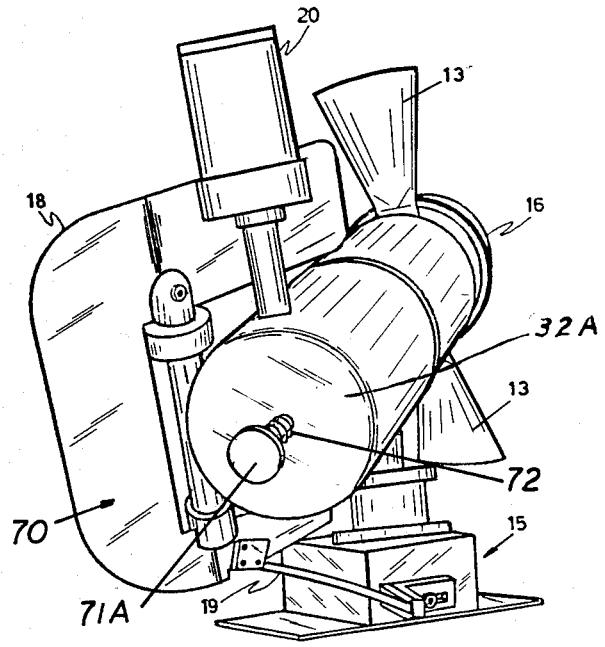
FIGS. 1 and 2 are rear and side perspective views of the launcher according to this invention.
Figure 2:
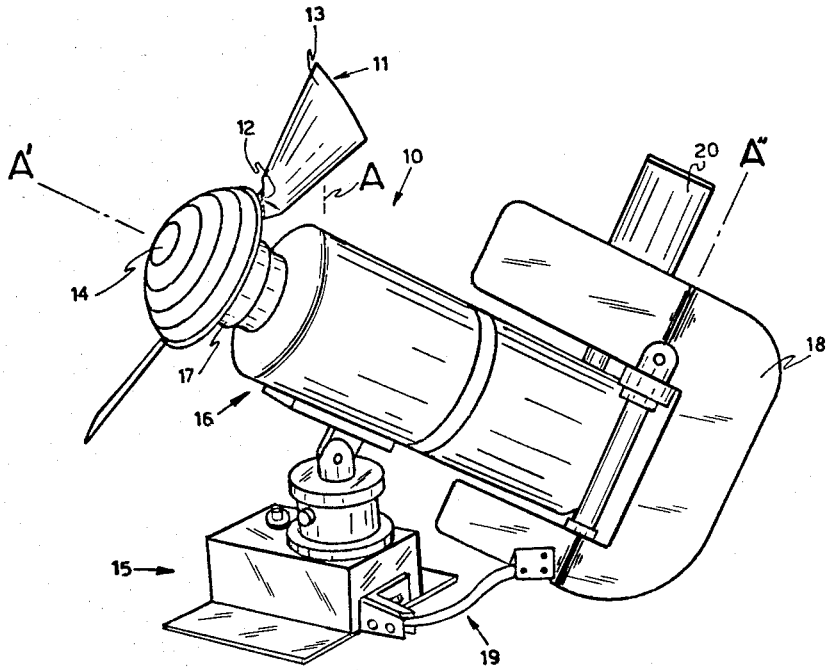

As seen in FIGS. 1 and 2 a launcher 10 according to the instant invention is used to launch a target pigeon 11 of the exact type described in my co-pending application Ser. No. 228,088 filed Jan. 26, 1981.

This target pigeon 11 comprises a wing member 13 shaped as a propeller type air foil and a detachable witness cap 14 which will release when hit by a shot. The peripheral portion 12 of the cap is releasably secured to the wing member in a manner to insure positive retension of the cap 14 to the wing member 13 during launch and which will positively separate when the cap is hit when in flight.

The launcher 10 comprises a base 15 defining a vertical swivel axis A for a motor unit 16 having a launcher head or hub 17 matable with the ring 12 of the hub or mounting portion of the pigeon 11 for rotation of this pigeon 11 about a motor axis A. On the rear end of the motor unit 16 a vane or rudder assembly 18 is pivotal about an axis A which lies in a plane perpendicular to the Axis A and in another plane perpendicular to this first plane and vertical. A retainer 19 is connected between the vane 18 and the base 15. In addition at its rear end the motor unit 16 carries a signal light 20.

More particularly and as better shown in FIG. 4, the base 15 comprises a base plate 21 adapted to be fixed on a fixed support and having an upstanding column 22 forming the base of a turntable having a top half 23 which can rotate on this column 22 about the axis A through an angle of 135°, defined between a central stop 24 carried on the upper part 23 and a pair of lower stops 25 carried on the lower part or column 22. The upper part 23 is provided with a lug 26 formed as a clevis to which a tab 27 carried on the motor unit 16 is secured by means of a loosenable wing nut 28 so that the inclination of the motor unit 16, and therefore of the axis A', can be changed about an axis A" extending horizontally and perpendicular to the axis A. The column 22 is provided at its rear end with a connecting block 28 to which one end of a double plastic-covered cable 29 constituting the retainer 19 is attached. The other end of this double plastic-covered cable 29 is attached to a block 30 secured to the vane 18 axially forward of the axis A.

The motor unit 16 has a pair of cylindrical cup-shaped housing halves 31 and 32, the former being provided with a mounting block 33 from which the tab 27 received in the clevis 26 extends. These two housing halves 31 and 32 form a watertight assembly which houses an electric motor 34 having a tubular output shaft 35 centered on the axis A. The head 17, which is of substantially the same design as in the above-cited U.S. Pat. No. 4,077,384, is fixed to the axial front end of the shaft 35. This head 17 has a tip 36 provided with a laterally projecting beak 37, and with a pair of drive pins 38 as described in the above-cited patents as well as in above-cited co-pending application No. 065,467, except that in this model the drive pins 38 are formed with sharp conical points.

The head 17 is provided internally with a pusher cup 39 mounted on one end of a pusher rod 40 extending co-axially through a bore in the motor shaft 35. This pusher cup 39 is biased axially backwardly by means of a compression spring 41, and can press a pair of retaining balls 42 radially outwardly into an outer position projecting from the side of the tip 36. At its rear end the pusher rod 40 is connected an axial-thrust bearing 43 against which the plunger 44 of a solenoid 45 bears The solenoid is mounted via a suitable mounting block or means 46 on the rear end of the motor 34, and within the rear housing half 32. Energization of this solenoid 45 pushes the solenoid plunger 44 axially forwardly, toward the left in FIG. 4, to compress the spring 41 and allow the balls 42 to retract radially inwardly. When not energized, the element 39 will hold the balls 42 in a radial outer position and lock the target pigeon 11 tightly in place on the head 17.

Figure 5:
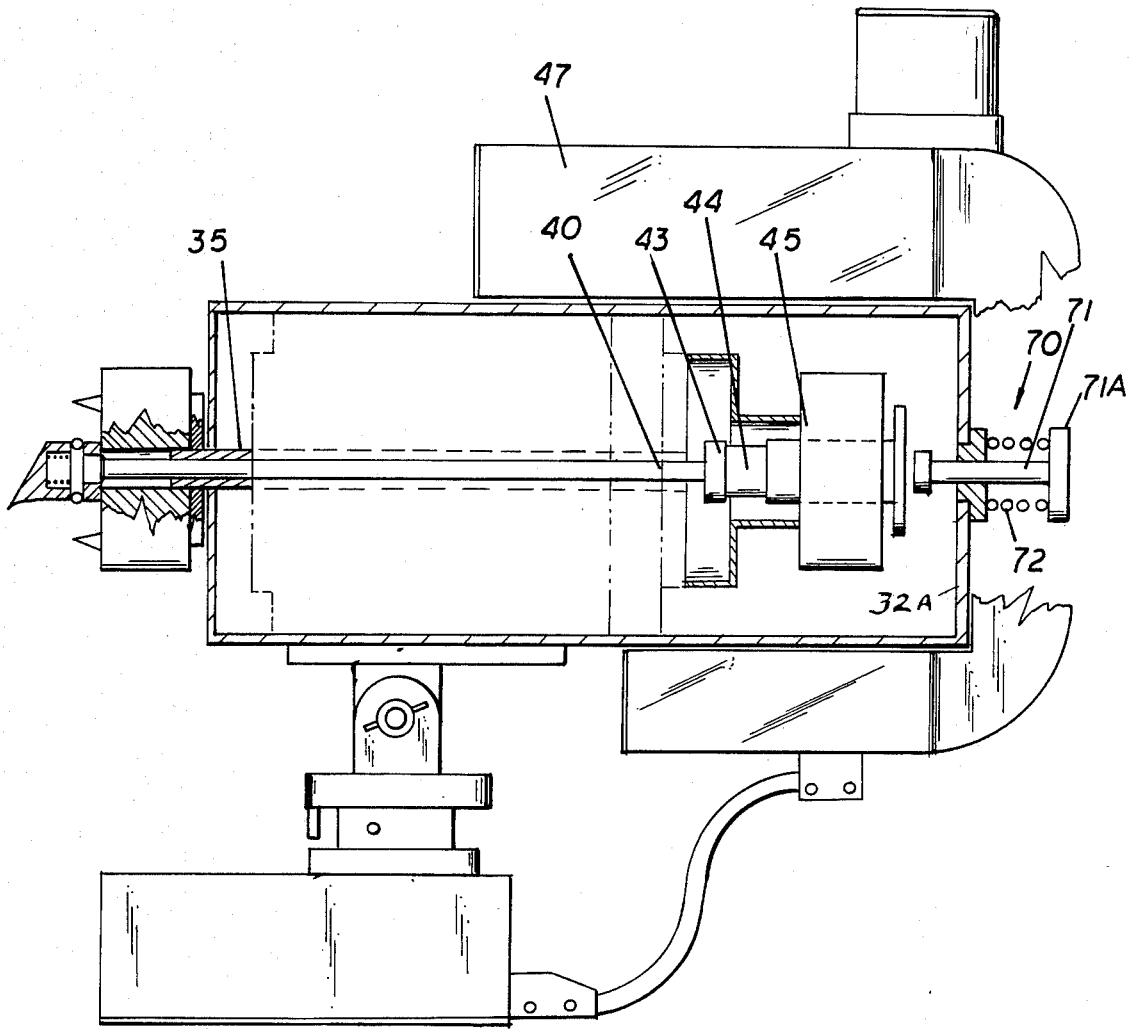
FIG. 5 is a fragmentary sectional view illustrating the details of the manual actuator to facillitate manual loading and unloading of the target pigeon to the launcher.

To provide for manual displacement of the balls or ball detents 42 inwardly to facillitate loading of the target pigeon 11 onto hub 17, a manual actuator 70 is operatively associated with the solenoid plunger 44 and control rod 40. As shown, the actuator 70 extends beyond the rear wall 32A of the rear housing 32. The arrangement is such that the actuator 70 comprises a slide rod abutting the end of the solenoid plunger 44 so that a manual force applied on the end 71A of the rod 71 effects displacement of plunger 44 and rod 40 to the left as seen in FIG. 4. Such displacement effects sufficient displacement of the pusher cup to permit the balls 42 to move inwardly as the target pigeon is slipped on the hub 37 thereby permitting the target pigeon to be loaded onto the hub 37. Upon release of this manual force, the compression spring 41 and spring 72 will function to bias the control rod 40 and actuator 70 to the right as seen in FIG. 4, causing the balls 42 to be pushed radially outward and thereby lock the target pigeon onto the hub 17 in a position ready for launching. In launch, the target pigeon, the solenoid 45 is remotely actuated by a suitable control. The actuation of the solenoid causes the plunger 44 to be shifted to the left as seen in FIGS. 4 and 5 causing the control rod 40 to shift to the left. In doing so, the retainer balls 42 will be forced inwardly as the whirling target pigeon 11 is released.

The vane 18 is generally J-shaped, having a long upper leg 47 extending parallel to the axis A, a short lower leg 48 coplanar with the leg 47, and a rear bight portion 49 interconnecting the two legs 47 and 48 but bent at an angle of between 10° and 20°, here 15°, to the plane P of the two legs 47 and 48. A rod 50 is held by bolts on one side of the rear end of the housing half 32. This rod 50 is seated at its upper and lower ends in respective bearings 51 and 52 on the arms 47 and 48 of the vane 18 so that this vane 18 can pivot relative the axis A' on the rod 50. At the upper end of this rod 50 a radially projecting stop screw 53 is engaged in an angularly extending notch 54 of a skirt 55 of the bearing 51 fixed on the vane 18. This notch 54 has an angular dimension relative to the axis A' equal to 90° plus the angular dimension of the stop 53, so that the vane 18 can pivot through 90° about the axis A". The stop 53 is set so that as seen in FIG. 3 the vane 18 can move from a position with its plane P inclined at 30° to a vertical plane including the axis A', as indicated in dot-dash lines of FIG. 3 to a position inclined oppositely at 60° to a vertical plane including the axis A', as indicated in dot-dot-dash lines of FIG. 3.

A target pigeon 11 is mounted on the head 17 either by momentarily energizing the solenoid 45 to allow the balls 42 to retract while the target pigeon is pushed over the tip 36, or by depressing a button at the rear end of the motor 16 to manually displace the rod 40 forwardly. The drive pins 38 will fit within corresponding holes on the target pigeon 11 so as rotationally to lock it tightly to the head 17, whereas the balls 42 will prevent axial displacement of the target pigeon relative to the head 17.

When the motor 34 is energized the target pigeon 11 will therefore be rotated at a speed normally between 5000 RPM and 8000 RPM. This rotation of the target pigeon 11 will cause the wings 13 of the target pigeon to generate a backwardly flowing current or atream of air that will pass backwardly over the motor unit 16 and that will impinge the vane 18, as the radial reach of the wings 13 of the target pigeon 11 is much greater than the corresponding dimension of the motor unit 16.

Figure 3:
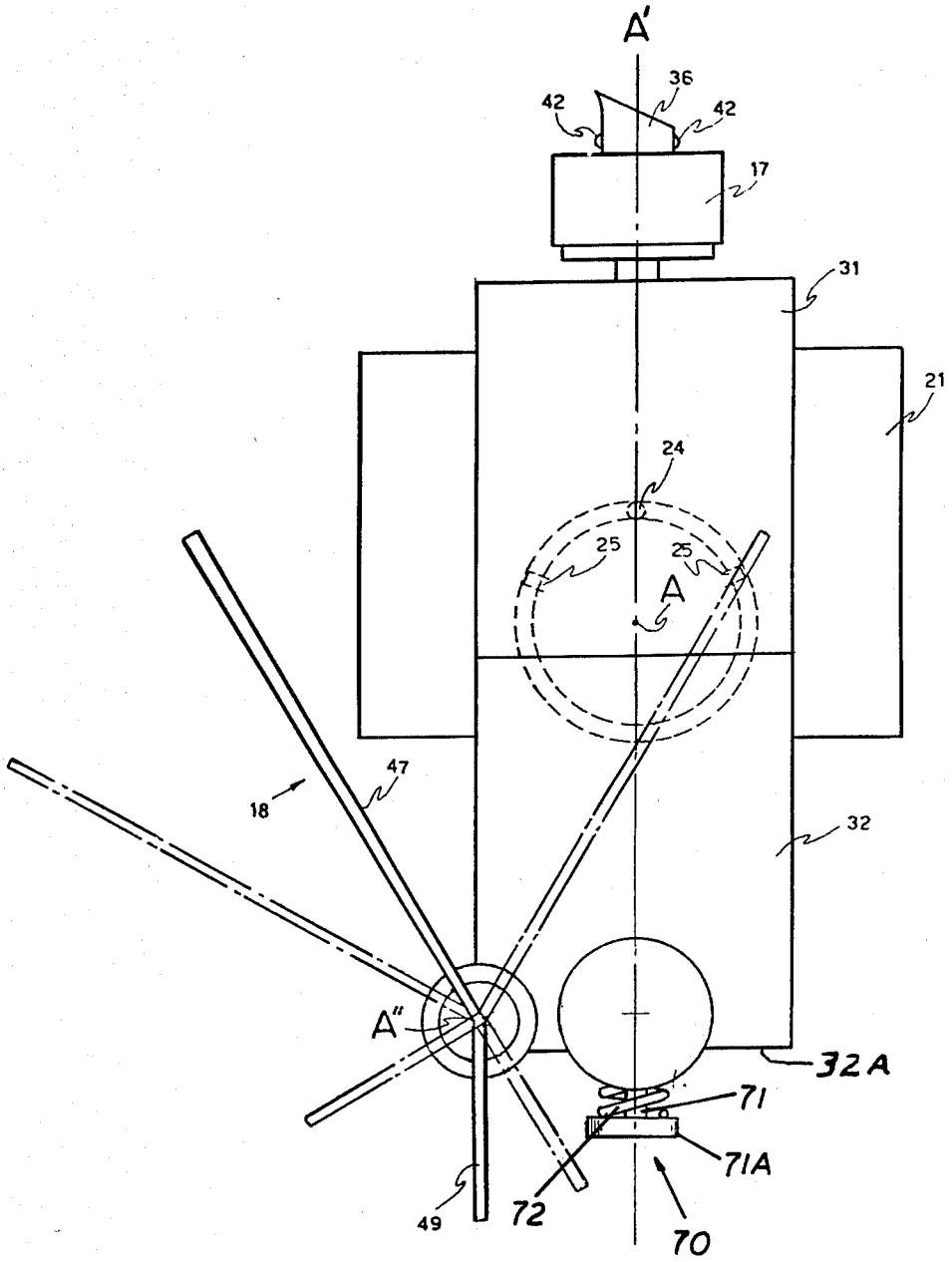
FIG. 3 is a large-scale top view of the launcher according to this invention.
Figure 3:
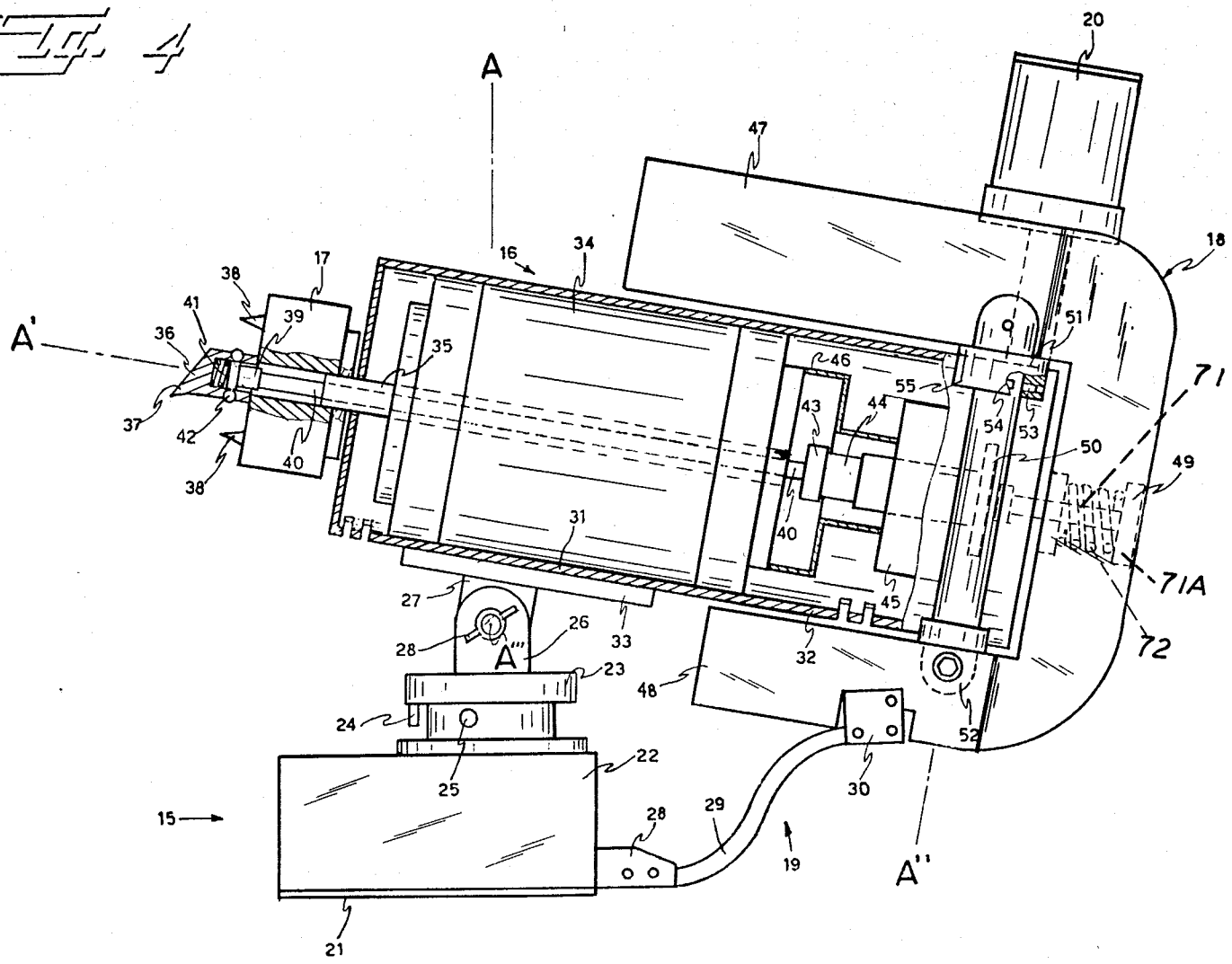

Assuming that the entire apparatus is in the position shown in solid lines in FIG. 3 when the motor 34 is energized with the target pigeon mounted on the head 17, the backwardly flowing current of air will impinge the one side of the vane 18, obviously deflecting it couterclockwise as seen in FIG. 3 about the axis A" into the position indicated at the dash-dot-dot line. In this position the backwardly flowing current of air is deflected toward the right so that the entire motor unit 16 will be urged rotationally clockwise, as seen in FIG. 3. This clockwise swiveling of the entire motor unit 16 will continue until at approximately the same time the stop pin 24 will engage the right-hand stop pin 25, and the retainer 19 is pulled tight. The retainer 19, when jerked tight, will immediately pivot the vane 18 from the position indicated in dash-dot-dot lines in FIG. 3 to the position indicated in dot-dash lines in FIG. 3, oppositely inclined relative to the axis A'. When thus inclined, obviously, the backwardly flowing stream of air from the wing 13 of the target pigeon 11 will be deflected toward the left, thereby urging the motor unit 16 rotationally counterclockwise about the axis A.

Such counterclockwise swiveling of the unit 16 will continue until the pin 24 engages the left-hand stop pin 25 and until once again the retainer 19 jerks tight and reverses the inclination direction of the vane 18.

The entire motor unit 16 will therefore oscillate rapidly back and forth through 135°, with the vane 18 synchronously oscillating back and forth through 90°. All of the energy necessary for this swiveling operation is generated by the motor 34, and is effective through the backwardly flowing air stream created by the pigeon wings 13. No extra cams, drives or any other complex apparatus is provided in order to convert the rotary motion of the motor 34 into a rapid oscillation of the entire motor unit 16.

During such oscillation the solenoid 45 can be energized in order to momentarily push the rod 40 forwardly and allow the balls 42 to retract. This action frees the target pigeon to fly axially forwardly off the head 17, being deflected by the tip 37 somewhat laterally so the target pigeon will follow a trajectory having the randomness of a flushed live bird. As soon as the pigeon leaves the head 17, the oscillation will stop.

Normally, the device according to the instant invention is provided in sets of three spaced apart over an angle of approximately 165° from a shooter stand, with each of the launchers 10 lying at a distance of at least 25 meters from the shooter stand, and with the launchers 10 being below grade so that only the signal lights 20 are visible to the shooter. A so-called puller has a three-button control, having a "ready" button, a "pull" button, and a "stop" button. When the shooter declares himself to be ready to shoot the puller pushes the "ready" button which starts all three of the motors 34 rotating at the desired speeds. This will cause all three of the partially hidden launchers 10 to rotate their respective target pigeons 11 and simultaneously oscillate back and forth through 135° as described above.

When prepared to fire, the shooter shouts "Pull" and the puller presses the "pull" button of the control unit, which first causes the light 20 of one of the launchers 10 to flash, and then one-fifth of a second later, energizes the respective solenoid 45 to release the respective target pigeon 11. A master control unit determines at random which one of the three launchers 10 shall launch its target pigeon so that the shooter will not be able to guess until the respective lamp 20 is lighted where the target pigeon is coming from. The lamp 20, however, does give the shooter a short warning, exactly of the type normally given in live-pigeon shooting when the door of the trap springs open a short instant before the pigeon emerges.

The unit operated by the puller can be connected via a cable to the operating circuitry for the launchers, but is preferably of the wireless type, operating, for instance, by means of infrared light so that the shooting field is not emcumbered with wires. The "stop" button on the remote control transmitter will, when pressed, de-energize all of the motors 34. It is impossible normally to energize the solenoids 45 unless the respective motors 34 are already energized, and when the solenoids 45 are energized the respective motors 34 are normally simultaneously de-energized.

As described above, the apparatus has two systems for limiting the angular displacement of the motor unit 16 relative to the base 15, the one constituted by the stop 24 and the two stops 25, and the other constituted by the retaining element 19. In fact the parts 24 and 25 are redundant, as the length of the plastic-covered double cable is normally set so that the pin 24 can never quite engage the stops 25. In the event that the cable 29 breaks, stretches, or comes loose at one end, however, the pin 24 will abutt the approximate stop 25 to prevent the respective motor unit 16 from rotating wildly in one direction about the axis A, conceivably ripping loose and damaging its feed cable. Thus the retainer 19 serves the double function of limiting the angular displacement of the motor unit 16 on the base 15 and of reversing the inclination of the vane 18 at each end of the angular displacement of the motor unit 16 on the base 15.

The arrangement described above offers all of the advantages of the substantially more complex launching apparatus described in the above-cited U.S. Pat. No. 4,077,384. At the same time this apparatus can be produced at a fraction of the cost of this unit so as to make this sport substantially cheaper. The positive locking means constituted by the balls 42 is provided on the instant apparatus, so as surely to prevent premature launching of the target pigeon. The possibility of inclining the axis A' relative to the horizontal by adjustment of the wing nut 28 is also an important advantage that allows variations in terrain to be compensated for. The device according to this invention can easily be made weather-proof, so that it can be left outside in inclement weather, as all of the electrical parts are hermetically sealed between the two halves 31 and 32.

Figure 7:
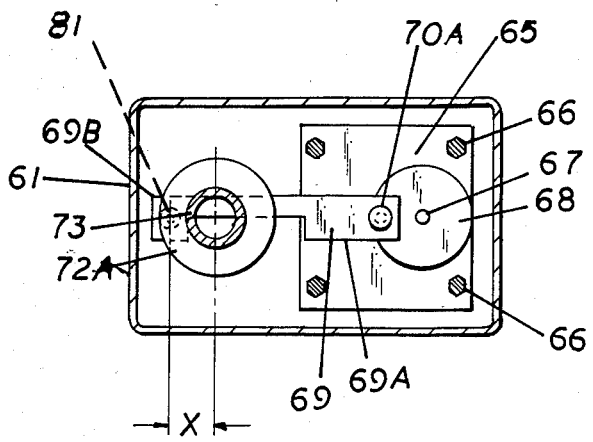
FIG. 7 is a plan view taken along line 7—7 on FIG. 6.
Figure 6:
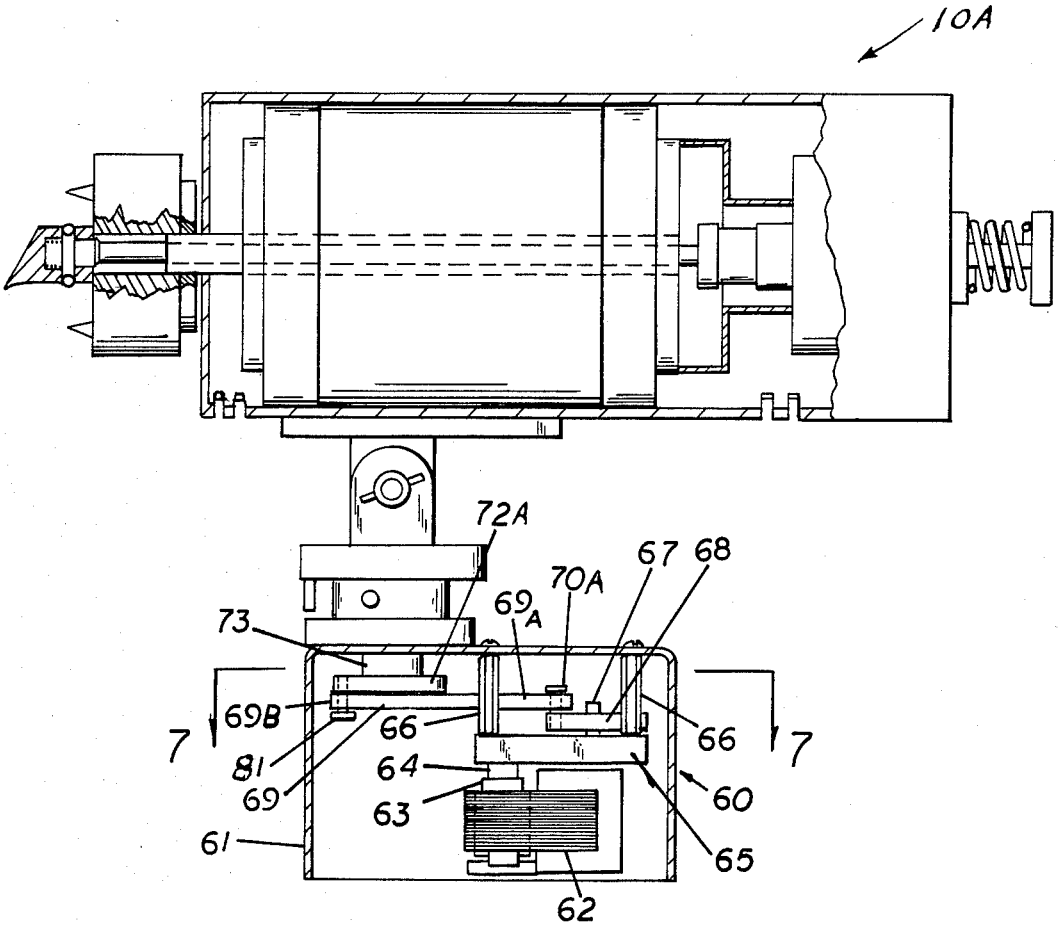
FIG. 6 is a fragmentary side sectional view illustrating an alternate form of mechanism to effect oscillation of the launcher through a predetermined anglar movement in asmuth.

FIGS. 6 and 7 illustrate a modified construction whereby an alternate means is provided to effect controlled oscillation of the launcher 10 through a predetermined angle in asmuth. It will be understood that the alternate oscillating means hereinafter described may be utilized in lieu of the rudder or vane means hereinbefore described with respect to FIGS. 1 to 4.

As best seen in FIG. 6, the launcher 10A is similar to that described with respect to FIGS. 1 to 4 except that the rudder or vane assembly 18 has been eliminated. In lieu thereof, oscillation of the launcher 10A about its vertical axis of rotation is mechanically effected by a motor driven eccentric drive 60. The eccentric drive means 60 is incorporated in the base portion 61 of the launcher 10A. The eccentric drive means includes a small motor 62 disposed within the base 61. The output shaft 63 of the motor 62 is connected to the input 64 of a gear reduction unit 65 which is suitably held in place by fasteners 66. The output shaft 67 of the reducer unit 63 has connected thereto an eccentric 68 in the form of a disk which is fixedly connected to the output shaft 67. Connected to the disk 68 in offset relationship to its axis of rotation about the output shaft 67 is a tie rod or connecting link 69. As shown, one end 69A of the connecting link 69 is pivotally connected to the disk 68 about a pivot pin 70A. The other end 69B is pivotally connected about a pivot pin 81 connected to a peripheral portion of a second disk 72A to define a second eccentric which is journal to the shaft 73 to which the launcher 10A is connected for movement in asmuth about a vertical axis.

As best seen in FIG. 7, the distance X between centers of the shaft 73 and the pivot connection 81 is greater than the distance between centers of the gear reduction output shaft 67 and the pin connection 70A. Preferably, the distance between the former centers is approximately 14.5% greater than the distance between the latter defined centers. With the eccentric motor drive unit 60 described, it will be apparent that when the motor 62 is energized, it will effect rotation of the disk 68 in 360° revolutions. The rotation of disk 68 is transmitted through the connecting rod 69 to effect oscillation of the eccentric 72A and connected shaft 73 to result in oscillation of the launcher 10A through a predetermined angle in asmuth. In all other respects the construction and operation of the launcher 10A is similar to that herein described with respect to FIGS. 1 to 4.

While the invention has been described with respect to one or more embodiments, variation and modification may be made without departing from the spirit or scope of the invention.

I claim:

1. In combination with a target pigeon having a hub and a pair of propeller-type wings extending oppositely from said hub, a launcher comprising:

a drive unit including a motor and having an output shaft rotatable about a shaft axis;

a base underneath said unit and provided with mounting means for securing said unit to said base for permitting swiveling of said unit on said base about an upright swivel axis with said shaft axis transverse to said swivel axis;

a head fixed on said shaft and fittable with said hub;

retaining means for releasably securing said hub to said head with said wings extending radially from said shaft axis;

control means connected to said unit and to said retaining means for energizing said unit with said pigeon retained on said head for spinning said pigeon and thereby generating an axially backwardly flowing airstream;

a vane on said unit axially behind said head in said stream and pivotal about an upright vane axis between one end position inclined in one direction across said airstream and deflecting same to one side and another position inclined oppositely across said airstream and deflecting same to the opposite side, whereby when said vane is inclined in said one direction to said airstream said unit is urged rotationally about said swivel axis on said base in one rotational sense and when said vane is oppositely inclined said unit is urged in the opposite rotational sense; and means on said motor and on said base for reversing the inclination of said vane relative to said stream when said unit swivels on said base into either of two angularly offset reversing positions, whereby said unit with said pigeon will oscillate between said reversing positions.

2. The launcher defined in claim 1 wherein said shaft axis is generally horizontal.

3. The launcher defined in claim 1 wherein said motor has a motor shaft on which said head is fixedly mounted and said motor shaft constitutes said output shaft.

4. The launcher defined in claim 3 wherein said retaining means includes an element radially displaceable in said head and axially engageable of said pigeon forwardly of said hub, a control rod extending co-axially through said motor shaft, and a solenoid in said motor axially behind said motor and connected via said control rod with said element.

5. The launcher defined in claim 4 wherein said element is a radially displaceable ball, said retaining means including a spring normally urging said rod backwardly and said ball radially outwardly into a position projecting radially from said head.

6. The launcher defined in claim 1 wherein said vane axis is horizontally laterally offset from said motor axis.

7. The launcher defined in claim 6 wherein said vane is C-shaped, having one leg extending axially forwardly from said vane axis above said drive unit, another leg extending axially forwardly from said vane axis beneath said drive unit, and a bight extending vertically between said legs axially behind said motor and said vane axis.

8. The launcher defined in claim 7 wherein said one leg is longer than said other leg.

9. The launcher defined in claim 7 wherein said legs are coplanar in a plane including said vane axis and said bight is planar and bent at an angle of between 10° and 20° to the plane of said legs.

10. The launcher defined in claim 7 wherein said motor has a generally cylindrical housing centered on said shaft axis, said vane being generally tangent to said housing.

11. The launcher defined in claim 1 wherein said means for reversing includes a tether connected between said base and a location on said vane offset from said vane axis.

12. The launcher defined in claim 11 wherein said tether is flexible and inextensible and is taut in each of said reversing positions.

13. The launcher defined in claim 1, further comprising means for tilting said motor on said base unit about a horizontal tilt axis underneath said motor, whereby said shaft and vane axis can be set at any of a plurality of angularly offset positions relative to said swivel axis.

14. The launcher defined in claim 1, further comprising means including stops on said base and motor for limiting angular displacement of said motor about said swivel axis on said base unit to a predetermined angle.

15. The launcher defined in claim 1, further comprising means including stops on said vane and on said motor for limiting angular displacement of said vane on said motor about said vane axis to a predetermined angle.

16. A launcher for launching a target pigeon having a propeller shaped wing comprising, a base, a motor means mounted on said base for rotating said pigeon, said motor means having a rotating shaft, said shaft having a bore extending longitudinally therethrough, a control rod slidably and displaceably mounted in said bore, a head connected to said shaft to rotate therewith when said motor means is energized, retainer means operatively associated with said head for detachably securing the propeller shaped wing of said target pigeon to said head, said control rod acting on said retainer means, actuating means for effecting the displacement of said control rod for facillitating the loading and release of said target pigeon relative to the head of said launcher.

17. A launcher as defined in claim 16 wherein said actuating means comprises a solenoid having a plunger acting on said control rod to effect the displacement thereof when said solenoid is activated.

18. A launcher as defined in claim 16 and including a manual actutator for effecting displacement of said control rod to facillitate loading said target pigeon on said head.

19. A launcher as defined in claim 16 and including means for effecting oscillation of said motor means relative to said base.

20. A launcher for launching target pigeons comprising a base, a mounting shaft rotatably journalled on said base, a launcher housing mounted on said shaft to move therewith, a motor mounted on said launcher housing, said motor having a motor shaft, a bore extending longitudinally of said motor shaft, a launching head connected to the end of said motor shaft, said launching head having a beak extending therefrom, retainer means disposed on said beak adapted for releasably latching thereon a target member, a control rod slidably disposed within said bore, said control rod being operatively associated with said retaining means, an actuating means acting on said control rod to effect the operation of said retaining means between a target latching condition and a releasing condition, and means operatively associated with said housing for periodically moving said housing in asmuth about said mounting shaft during the operation of said launcher.

21. A launcher as defined in claim 20 wherein said last mentioned means includes a vane pivotally connected to said housing.

22. A launcher as defined in claim 20 wherein said last mentioned means includes a motor drive means for rotating a pigeon, a reduction gear unit connected to said motor drive means, said reduction gear unit having an output shaft, an eccentric journalled to said output shaft, another eccentric connected to said mounting shaft, and an interconnecting tie rod connected between said eccentrics whereby said housing is oscillated about the axis of rotation of said mounting shaft as said motor drive means is actuated.

23. A launcher as defined in claim 22 wherein the distance between the centers of the mounting shaft and the tie rod connection to the mounting shaft eccentric is greater than the distance between the centers of the tie rod connection and the reduction gear output eccentric.

* * * * *